US009945084B1

(12) United States Patent
Warford

(10) Patent No.: US 9,945,084 B1
(45) Date of Patent: Apr. 17, 2018

(54) VEHICLE DIVERSION BARRIER

(71) Applicant: Lawrence Eugene Warford, Bonney Lake, WA (US)

(72) Inventor: Lawrence Eugene Warford, Bonney Lake, WA (US)

( * ) Notice: Subject to any disclaimer, the term of this patent is extended or adjusted under 35 U.S.C. 154(b) by 0 days.

(21) Appl. No.: 15/367,177

(22) Filed: Dec. 2, 2016

(51) Int. Cl.
*E01F 15/00* (2006.01)
*E01F 15/04* (2006.01)
*E01F 15/08* (2006.01)

(52) U.S. Cl.
CPC ..... *E01F 15/0415* (2013.01); *E01F 15/04* (2013.01); *E01F 15/0423* (2013.01); *E01F 15/0438* (2013.01); *E01F 15/088* (2013.01)

(58) Field of Classification Search
CPC ... E01F 15/0415; E01F 15/04; E01F 15/0423; E01F 15/0438; E01F 15/088
USPC ..... 404/6, 9–11, 72
See application file for complete search history.

(56) References Cited

U.S. PATENT DOCUMENTS 3,643,924 A * 2/1972 Fitch ..... E01F 15/146 256/1
3,672,657 A * 6/1972 Young ..... E01F 15/145 104/254
3,674,115 A * 7/1972 Young ..... E01F 15/146 104/254
3,680,662 A * 8/1972 Walker ..... E01F 15/146 104/254
3,982,734 A * 9/1976 Walker ..... E01F 15/146 256/13.1
4,399,980 A * 8/1983 van Schie ..... E01F 15/146 188/377
4,452,431 A * 6/1984 Stephens ..... E01F 15/146 256/13.1
4,815,565 A * 3/1989 Sicking ..... E01F 15/146 256/1
4,923,327 A * 5/1990 Gorlov ..... E01F 13/046 404/6
5,217,318 A * 6/1993 Peppel ..... E01F 15/146 256/13.1
6,309,140 B1 * 10/2001 Kiedaisch ..... E01F 15/0415 114/219
6,533,495 B1 * 3/2003 Williams ..... E01F 15/0453 188/377
6,551,010 B1 * 4/2003 Kiedaisch ..... E01F 15/0415 256/13.1
6,702,513 B1 * 3/2004 Raupach ..... E01F 15/083 256/13.1
7,168,880 B2 * 1/2007 Kennedy, Jr. ..... C08G 18/10 404/10
7,410,320 B2 * 8/2008 Faller ..... E01F 15/145 404/6
8,491,216 B2 * 7/2013 Dyke ..... E01F 15/146 404/10

(Continued)

*Primary Examiner* — Raymond W Addie
(74) *Attorney, Agent, or Firm* — Joseph Z. Ellsworth

(57) ABSTRACT

A crash diversion barrier converts the forward momentum of a vehicle into a lateral motion that urges the vehicle back onto the road and minimizes the forces exerted on the vehicle. This is accomplished by having a linkage that is comprised of a diversion link, a reaction link and, a slider mechanism. The forward momentum of the vehicle rotates the diversion link which steers and translates the vehicle back onto the roadway. The angle of an entrance line of deflection is minimized to enhance safety of other vehicles on the roadway.

20 Claims, 6 Drawing Sheets

(56) References Cited

U.S. PATENT DOCUMENTS

| | | | | |
|---|---|---|---|---|
| 8,974,142 | B2 * | 3/2015 | Buehler | E01F 15/146 404/10 |
| 2002/0146283 | A1 * | 10/2002 | Kim | E01F 15/0492 404/6 |
| 2003/0210954 | A1 * | 11/2003 | Kang | E01F 15/146 404/6 |
| 2011/0293366 | A1 * | 12/2011 | Gerrard | E01F 15/0461 404/6 |

* cited by examiner

VEHICLE DIVERSION BARRIER

FIELD OF THE INVENTION

This invention relates to traffic safety devices. Specifically, a device to safely divert a vehicle back onto the road and minimize the forces exerted on the vehicle.

BACKGROUND

Jersey Barriers are designed to redirect a crash, using the vehicle's momentum to absorb the impact and slide the vehicle up parallel along the side of the barrier to prevent a rollover. An F-Shape barrier has the same 3-inch-high base, but features a side that slopes 10 inches above the pavement-three inches less than the side slope of the Jersey Barrier—and is thus able to better absorb proportional impacts from smaller chassis to prevent a rollover. Jersey Barriers as well as other barrier designs, including constant slope, single slope, and vertical are acceptable for adequately preventing roll-overs.

The start of a barrier is dangerous because with a head on crash the shape of the barrier is not effective in limiting crash momentum or preventing roll-overs. Typical solutions include Impact attenuators, crash cushions, water filled attenuators, and sand filled Fitch barriers.

Water-filled attenuators consist of containers filled with water to absorb impact energy. They are typically not anchored to the ground, and therefore benefit from easy deployment and relocation using barrier transfer machines and cranes. They are non-redirective, meaning they do not deflect vehicles that impact the side back into the roadway.

A Fitch barrier consists of sand-filled plastic barrels, usually yellow colored with a black lid. Fitch barriers are often found in a triangular arrangement at the end of a guard rail between a highway and an exit lane (the area known as the gore), along the most probable line of impact. The barriers in front contain the least sand, with each successive barrel containing more, so that when a vehicle collides with the barrels they shatter, the kinetic energy is dissipated by scattering the sand and the vehicle decelerates smoothly instead of violently striking a solid obstruction, reducing the risk of injury to the occupants.

Crash cushions are constructed of multiple segments, which crumple into each other when collided with to absorb the impact. Their main benefit is in their reusability; these attenuators can automatically return to their original position after a crash.

Impact attenuators are tested and classified based on the maximum speed of a vehicle during a collision for which the attenuator is designed. Therefore impact attenuators may not be effective for speeds or weights that are over the classification.

Most impact attenuators are completely destroyed by a single crash and the danger the now damaged impact attenuator is designed to protect could be exposed for months while the parts are replaced.

Also, the intense deceleration during a crash into an impact attenuator is still very dangerous to people and will surely damage a vehicle.

SUMMARY OF THE INVENTION

Solutions to the problems stated above have been solved by the current invention. A crash diversion barrier comprises a linkage that converts the forward momentum of a vehicle into a lateral motion that urges the car onto the road. This is accomplished by having a linkage that is comprised of a diversion link, a reaction link and, a slider mechanism. The forward momentum of the vehicle rotates the diversion link which steers and translates the vehicle back onto the roadway. The angle of an entrance line of deflection is minimized to enhance safety of other vehicles on the roadway.

The invention further includes a method of diverting a vehicle back onto a roadway by using the vehicles forward momentum to rotate a diversion link, which urges the vehicle laterally and provides a seamless transition for the vehicle to travel onto the roadway.

The method further comprises using the vehicles forward momentum to urge a sliding mechanism into a road partition. This motion rotates a diversion link about a slider pin and urges the vehicle laterally and provides a seamless transition for the vehicle to travel past the road partition. Preferably, the diversion link seals against the road partition at an edge and then returns to its original position.

DETAILED DESCRIPTION

Figure 1:
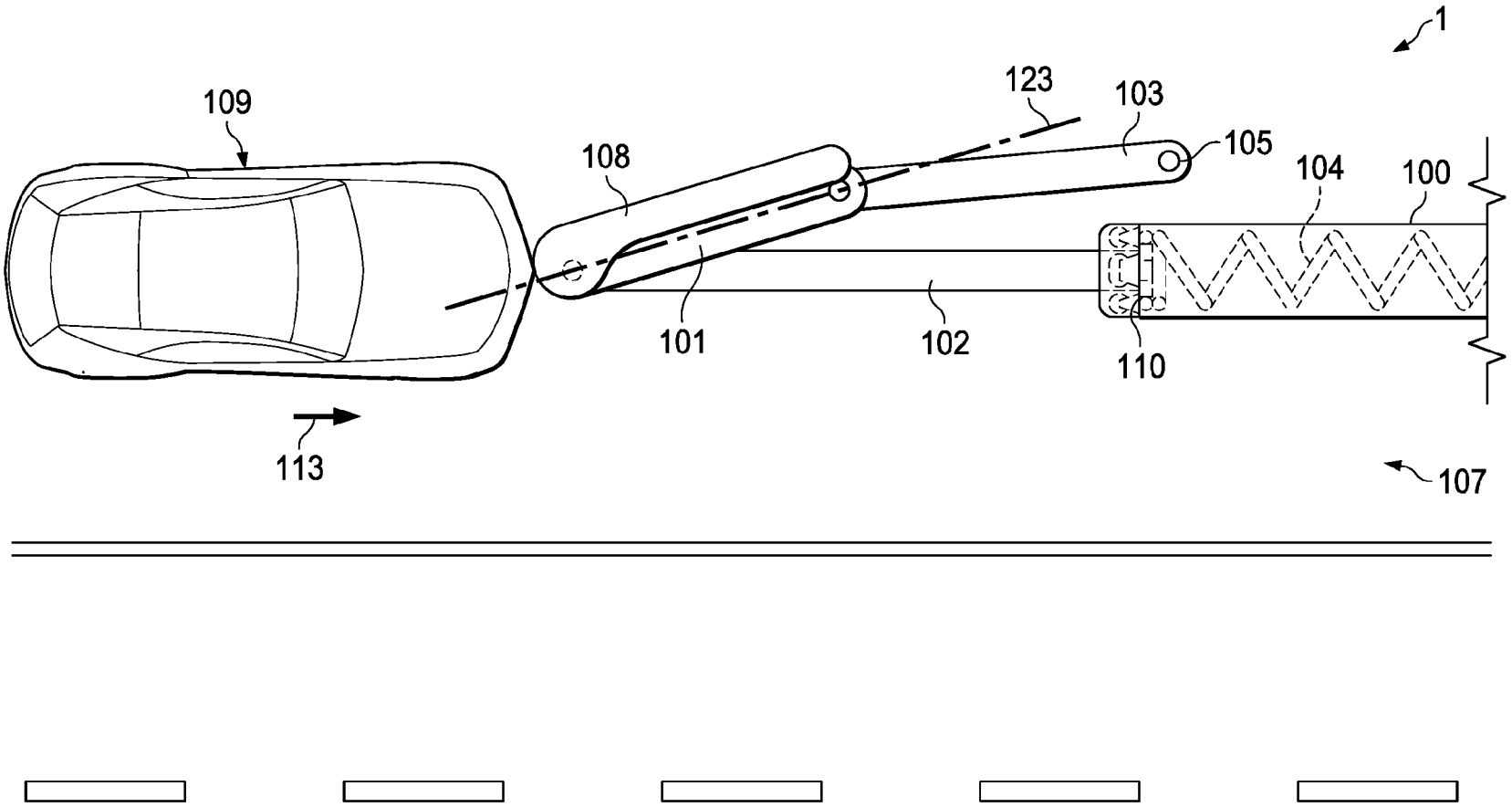
FIG. 1. Top view of the crash diversion barrier in the initial position.

The crash diversion barrier is contemplated to be part of a known road partition 100. The typical road partition 100 has a beginning portion that is not the ideal configuration for preventing injury to vehicles 109. A novel apparatus for preventing vehicle damage or injury at the start of a road partition 100 is a vehicle diversion barrier 1. The vehicle diversion barrier 1 works by using a linkage that converts the forward momentum 113 of a vehicle into a lateral motion 114 that urges the car back onto the shoulder 107 or onto the road 106.

The linkage is comprised of a diversion link 101, a reaction link 103 and a slider mechanism 102. A vehicle that goes off the road would hit a local impact attenuator 108 on the diversion link 101. The forward momentum 113 of the car will drive back the slider mechanism 102 into the road partition 100. The road partition 100 has a return spring 104 which returns the diversion barrier 1 to an initial position but it is not intended to attenuate momentum from the vehicle 109. On certain roadways it may be desirable to both attenuate momentum and divert a vehicle onto a roadway in which case the return spring 104 can be strengthened or the slider mechanism can be dampened. Any additional force in the return spring 104 will slow the vehicle but will also increase damage to the vehicle 109. A slidable surface 110 stabilizes the slider mechanism 102 to prevent binding up with lateral forces and provides a slidable surface to limit reaction forces. The diversion link 101 rotates about the reaction linkage 103. The reaction linkage 103 is pinned to the ground or other stationary item with a reaction pin 105. In one embodiment the movement of the slider mechanism 102 reacts very little force so the force is reacted by the stationary reaction pin 105. The movement of the slider mechanism 102 causes a diversion rotation 111 in the diversion link 101. The diversion link 101 moves the vehicle toward the road through one or both of: translation of the vehicle laterally and through steering the vehicle 109 onto a safe path. The lateral force 115 applied to the vehicle is reacted through the reaction link 103 which rotates about the reaction pin 105. A diversion link to road partition seal 112 allows the vehicle 109 to move past the road partition 100 onto the shoulder 107 without interference.

Figure 2:
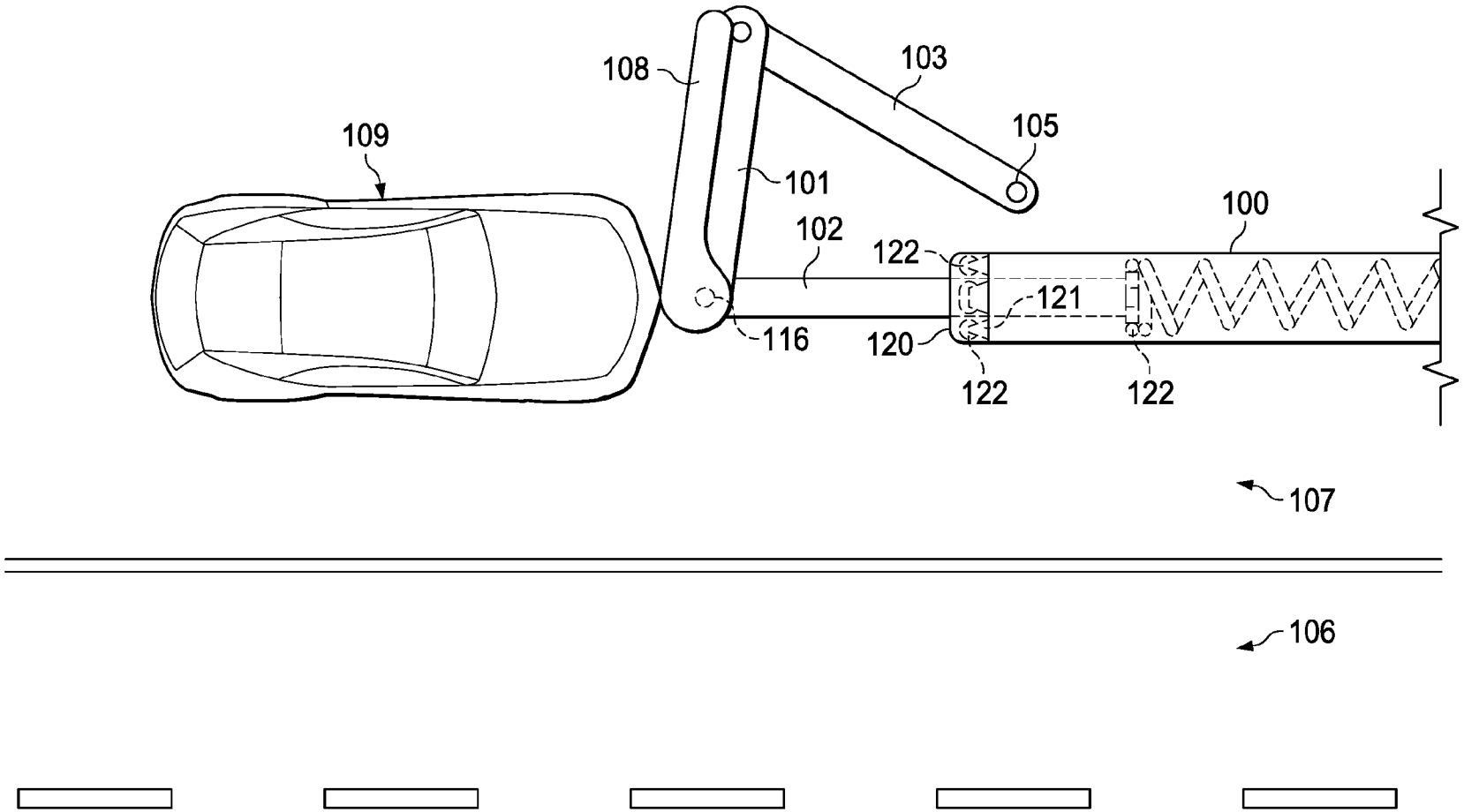
FIG. 2. Top view of the crash diversion barrier in a middle position.

Referring to FIG. 1, the vehicle diversion barrier is in its initial position. The slider mechanism 102 is fully extended. In the fully extended position an exit line of diversion 123 exists for a vehicle that is off to the left and would divert the vehicle into a median. The exit line of diversion 123 is minimized to prevent veering the vehicle into a dangerous position. Preferably, this angle would be 10 to 40 degrees from the road partition 1. Alternately, a vehicle first hits the local impact attenuator 108 which is designed to minimize damage to the vehicle or its occupants. The local impact attenuator 108 may be rubber or plastic or an airbag. Preferably, the local impact attenuator 108 would be plastic covered cushioning to add durability to the outside while cushioning the impact with foam or springs. In FIG. 2, the slider mechanism is partially pushed into the barrier by the vehicle 109. The diversion link 101 rotates around the slider pin 116 to begin moving the vehicle 109 back onto the shoulder 107.

Figure 3:
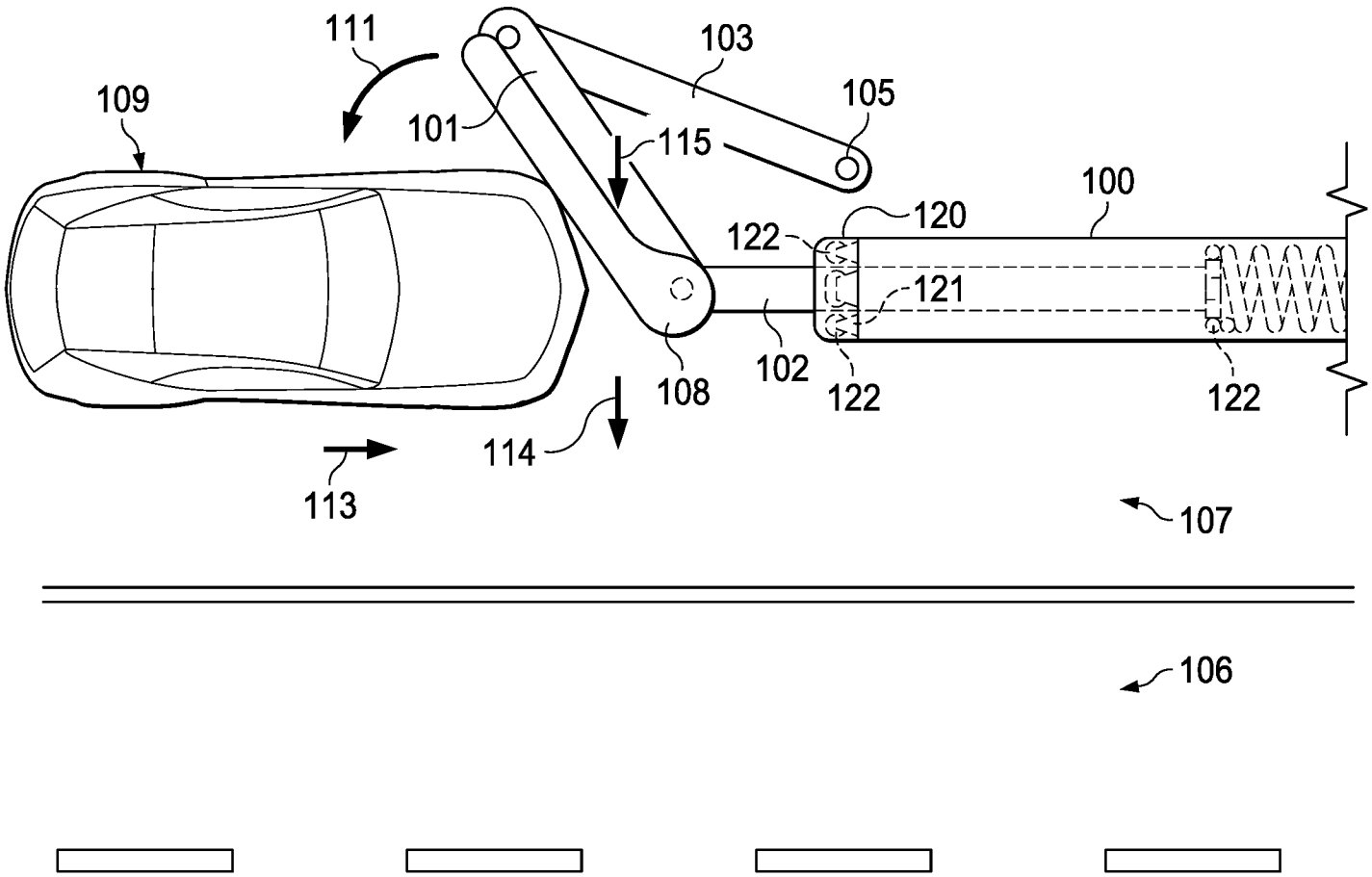
FIG. 3. Top view of the crash diversion barrier in a further along middle position.
Figure 4:
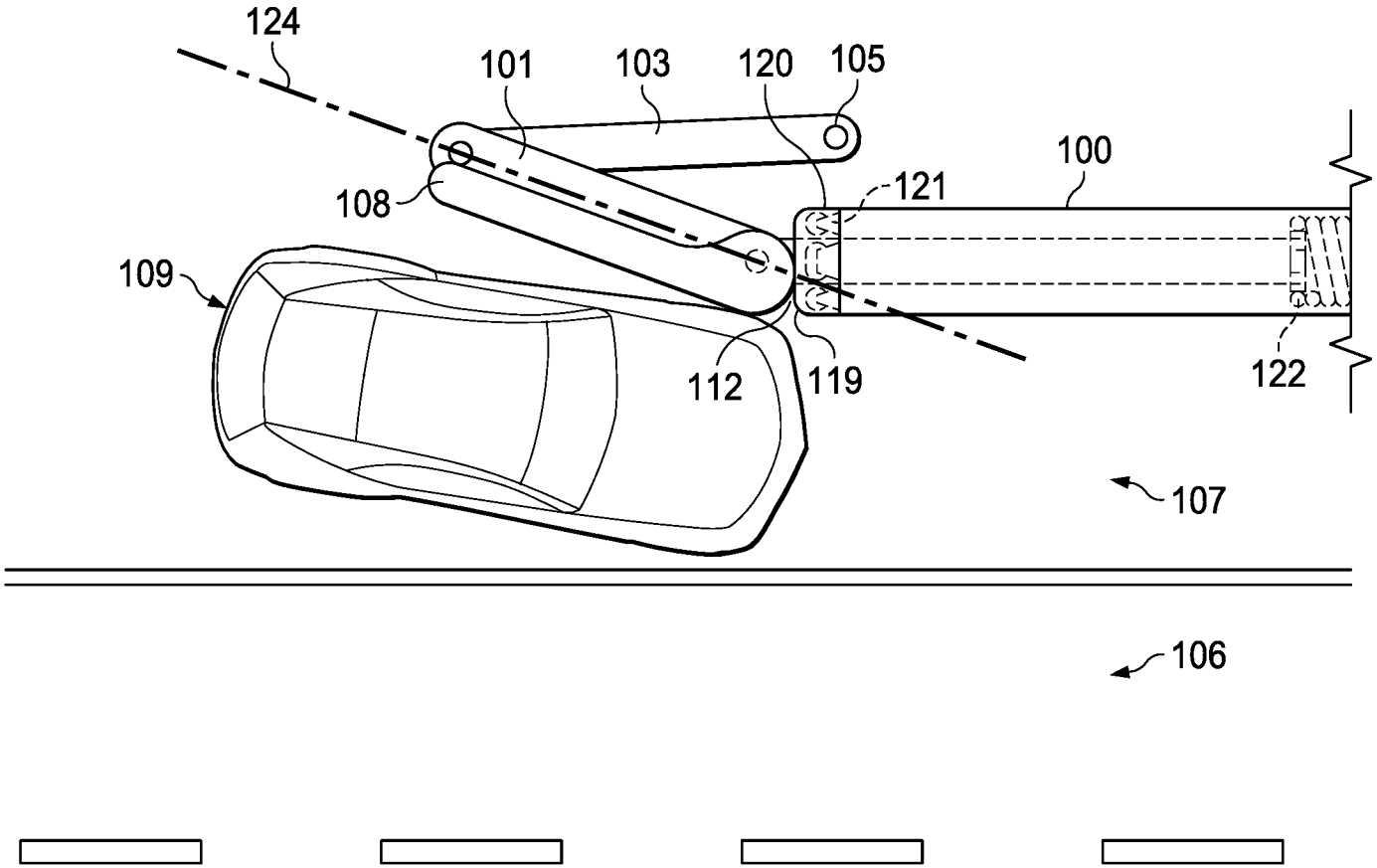
FIG. 4. Top view of the Crash diversion barrier in the final position.

Referring to FIG. 3 the Slider mechanism 102 is pushed proximate the road partition 100. The diversion link 101 is rotating and moving the vehicle toward the shoulder 107. The forward momentum 113 of the vehicle creates a diversion rotation 111 in the diversion link 101. This diversion rotation 111 causes a lateral force 115 on the front of the vehicle 109, which translates the vehicle and steers the vehicle toward the shoulder 107 of the road 106. In FIG. 4 the diversion link 101 makes a diversion link to road partition seal 112 which is a smooth transition for the vehicle 109 as it travels past the diversion link 101 adjacent to the road partition 100. An entering line of deflection 124 is minimized to minimize the change in direction of the vehicle. This entering line of deflection 124 should be between 5 and 25 degrees from the road partition.

Figure 5:
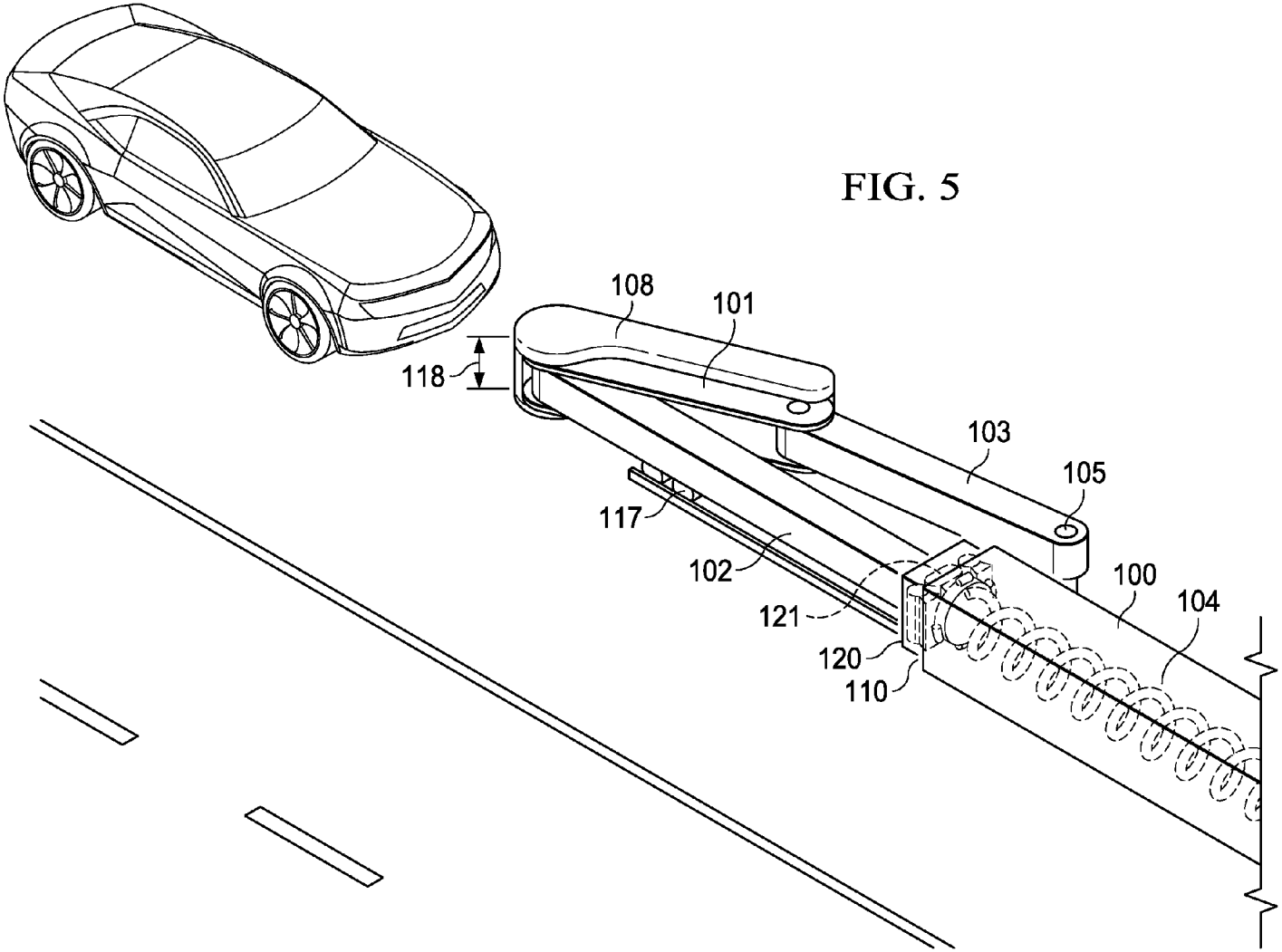
FIG. 5. Isometric view of the crash diversion barrier in the initial position.
Figure 6:
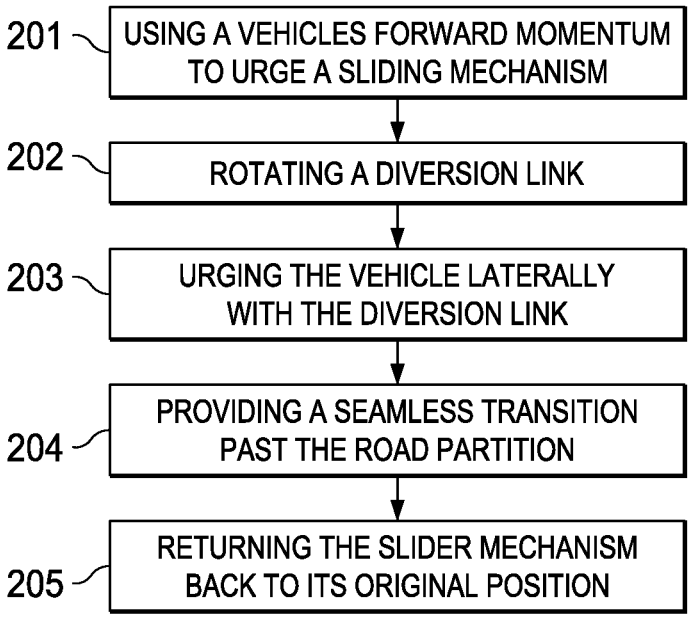
FIG. 6. Flow chart of a method for diverting a vehicle back onto the roadway.

FIG. 5, shows a side view of the vehicle diversion barrier. A cut away view shows the return spring 104 which returns the slider mechanism 101 to the initial position after an interaction with a vehicle 109. The slider mechanism 101 may be cantilevered out away from the road partition 100 or it may have a slidable support 117. This slidable support 117 may take the form of wheels, wheels on a track, or a sled. The diversion link 101 has a diversion link height 118 which is the height of a bumper or between 1 and 4 feet high.

According to FIGS. 1-4 method of diverting a vehicle 109 back onto a shoulder 107 of roadway 106 comprises the following steps: using the vehicles forward momentum 113 to urge a sliding mechanism 102 into a road partition 100; rotating a diversion link 101 about a slider pin 116; urging the vehicle 109 laterally with the diversion link 101; providing a seamless transition for the vehicle to travel past the road partition 100, preferably by sealing the diversion link 101 against the road partition 100 at its edge 119 and; returning the slider mechanism 102 to its original position.

The using the vehicles momentum step 201 further comprises providing a slidable surface 110 in the road partition 100 to limit forces acting against the vehicle to prevent damage to the slider mechanism 102. The slidable surface may be external rollers 121 or a bushing made of Teflon or Teflon blocks or other wear resistant, low friction material. The external rollers 121 would provide low friction support the slider mechanism 102. Also, the ends of the slider mechanism 102 would have internal rollers 122 that roll down the inside of the vehicle barrier. A protective boot 120 is designed to cover the rollers and the opening to the barrier to prevent debris from damaging or interfering with movement of the device.

Further, step 201 may comprise providing a local impact attenuator 108 to cushion the initial impact. A diversion link height 118 ensures the vehicle 109 impacts the diversion link 101 without travelling over the vehicle diversion barrier 1 and causing more damage to the vehicle 109 or its occupants. The diversion link height 118 is in a range of 1 to 4 feet which will fit the height of most vehicle bumpers.

The rotating a diversion link step 202 may further comprise: the diversion link 101 rotating about a reaction linkage 103. The reaction linkage 103 is pinned to the ground or other stationary item with a reaction pin 105. The movement of the slider mechanism 102 may react very little force so the force needed to urge the vehicle back onto the shoulder is reacted by the stationary reaction pin 105.

The urging the vehicle laterally step 203 further comprises: applying a lateral force 115 to the front of the vehicle. The lateral force 115 translates the vehicle and steers the vehicle toward the shoulder 107 of the road 106. The lateral force 115 is a result of the diversion rotation 111 of the diversion link 101.

The providing a seamless transition step 204 further comprises: rotating the diversion link 101 to a position even or beyond the edge 119 of the road partition 100 allowing a vehicle to transition past the road partition 100 without impacting it. The diversion link 101 may seal against the road partition edge 119 creating a diversion link to road partition seal 112.

The returning the slider mechanism step 205 may further comprises: a return spring 104 to providing force to return the slider mechanism to its original position. The force required to return the slider mechanism to its original position may also be compressed air. A hydraulic shock could be used as a dampener to slow the vehicle or slow the return of the diversion link to the original position. A slidable surface 110 reduces the force of friction at the road partition interface and allows the slider mechanism 102 to return with lower force. The slider mechanism may be cantilevered a considerable distance and therefore a slidable support 117 may be provided to reduce loads on the slider mechanism 102 and, to lower return force required in the return spring 104.

A crash diversion barrier 1 comprises, a linkage that converts the forward momentum 113 of a vehicle 106 into a lateral motion 114 that urges the car onto the road. The linkage is comprised of a diversion link 101, a reaction link 103 and, a slider mechanism 102. A local impact attenuator 108 on the diversion link 101 limits damage to the vehicle. The forward momentum 113 of the vehicle drives back the slider mechanism 102 into a road partition 100 and a return spring 104 returns the linkage to the initial position. A slidable surface 110 stabilizes the slider mechanism 102 to prevent binding up with lateral forces and provides low friction to limit reaction forces on the vehicle. The slidable surface 110 may be accomplished by having external rollers 121 on the road partition 100 rolling against the slider mechanism 102. The slider mechanism 102 may also have internal rollers 122 attached that roll against the interior of the road partition 100.

Movement of the slider mechanism 102 causes a diversion rotation 111 in the diversion link 101 configured to urge the vehicle toward the road through one or both of: translation of the vehicle laterally and through steering the vehicle. The forward momentum 114 of the vehicle creates a diversion rotation 111 in the diversion link 101 which causes a lateral force 115 on the front of the vehicle which translates the vehicle and steers the vehicle toward the road. The diversion rotation 111 causes a linkage to a road partition seal 112 configured to allow the vehicle to move past the road partition onto the road without interference. A slidable support 117 is configured to support the linkage 1 to reduce loads on the slider mechanism 102 and to lower the return force required to return the linkage to the initial position.

A method of diverting a vehicle back onto a roadway comprises the following steps: using the vehicles forward momentum 113 to rotate a diversion link 101; urging the vehicle laterally with the diversion link 101; providing a seamless transition for the vehicle to travel onto the roadway. The vehicles forward momentum 113 urges a sliding mechanism 102 into a road partition 100. This rotates the diversion link 101 about the slider link 102 and urges the vehicle laterally, providing a seamless transition for the vehicle to travel past the road partition 100 by sealing the diversion link against the road partition at an edge 119. Then the slider mechanism 102 returns to its original position.

A slidable surface 110 is provided in the road partition 100 and a local impact attenuator 108 attenuates the initial impact of the vehicle.

The diversion link 101 rotates about a reaction link 103 wherein, the reaction linkage 103 is pinned to the ground or other stationary item with a reaction pin 105. A lateral force 115 is applied to the front of the vehicle wherein, the lateral force translates the vehicle and steers the vehicle toward the roadway. The seamless transition is provided by rotating the diversion link 101 to a position even or beyond the edge 119 of a road partition 100 allowing a vehicle to transition past the road partition without impacting it. The slider mechanism 102 returns to its initial position wherein, a return spring 104 provides the force to return the slider mechanism 102 to its original position. A slidable surface 110 allows the slider mechanism 102 to return with lower force. Loads may be reduced on the slider mechanism 102 with the support of a slidable support 117.

The invention claimed is:

1. A crash diversion barrier comprising,
a linkage that converts the forward momentum of a vehicle into a lateral motion that urges the vehicle onto the road wherein,
the linkage is comprised of
a diversion link,
a reaction link and,
a slider mechanism
a local impact attenuator on the diversion link wherein,
movement of the slider mechanism causes a diversion rotation in the diversion link configured to urge the vehicle toward the road through one or both of: translation of the vehicle laterally and steering the vehicle.

2. The crash diversion barrier of claim 1 wherein,
the forward momentum of the vehicle will drive back the slider mechanism into a road partition.

3. The crash diversion barrier of claim 1 further comprising,
a return spring which returns the linkage to an initial position.

4. The crash diversion barrier of claim 1 comprising,
a slidable surface configured to stabilize the slider mechanism and provide a low friction surface to limit reaction forces.

5. The crash diversion barrier of claim 1 wherein,
the forward momentum of the vehicle creates a diversion rotation in the diversion link which causes a lateral force on a front of the vehicle which translates the vehicle and steers the vehicle toward the road.

6. The crash diversion barrier of claim 1 comprising,
a linkage to a road partition seal configured to allow the vehicle to move onto the road without interference.

7. The crash diversion barrier of claim 1 comprising,
a slidable support configured to support the linkage to reduce loads on a slider mechanism to lower a return force required to return the linkage to an initial position.

8. A method of diverting a vehicle back onto a roadway comprising the following steps:
attenuating the initial impact of the vehicle with a local impact attenuator,
using the vehicles forward momentum to rotate a diversion link;
urging the vehicle laterally with the diversion link;
providing a seamless transition for the vehicle to travel onto the roadway,
using the vehicles forward momentum to urge a slider mechanism into a road partition;
rotating a diversion link about the slider mechanism;
urging the vehicle laterally with the diversion link;
providing a seamless transition for the vehicle to travel past the road partition, by sealing the diversion link against the road partition at an edge and;
returning the slider mechanism to its original position.

9. The method of claim 8 wherein,
the using the vehicles momentum step further comprises providing a slidable surface in a road partition.

10. The method of claim 8 further comprising,
rotating the diversion link about a reaction link wherein, the reaction linkage is pinned to the ground or other stationary item with a reaction pin.

11. The method of claim 8 further comprising: applying a lateral force to the front of the vehicle wherein, the lateral force translates the vehicle and steers the vehicle toward the roadway.

12. The method of claim 8 wherein,
the providing a seamless transition step further comprises:
rotating a diversion link to a position even or beyond the edge of a road partition allowing a vehicle to transition past the road partition without impacting it.

13. The method of claim 8 further comprising the step: returning the slider mechanism to its initial position wherein, a return spring provides the force to return the slider mechanism to its original position.

14. The method of claim 13 further comprising:
providing a slidable surface to allow the slider mechanism to return with lower force.

15. The method of claim 8 further comprising,
supporting the slider mechanism with a slidable support to reduce loads on the slider mechanism.

16. A crash diversion barrier comprising,
a linkage, wherein
the linkage is comprised of
a diversion link,
a reaction link and,
a slider mechanism
a local impact attenuator on the diversion link wherein, movement of the slider mechanism causes a diversion rotation in the diversion link configured to urge the vehicle toward the road through one or both of: translation of the vehicle laterally and steering the vehicle.

17. The crash diversion barrier of claim 16 wherein, the forward momentum of the vehicle will drive back the slider mechanism into a road partition.

18. The crash diversion barrier of claim 16 further comprising, a return spring which returns the linkage to an initial position.

19. The crash diversion barrier of claim 16 comprising, a slidable surface configured to stabilize the slider mechanism and provide a low friction surface to limit reaction forces.

20. The crash diversion barrier of claim 16 wherein, the forward momentum of the vehicle creates a diversion rotation in the diversion link which causes a lateral force on a front of the vehicle which translates the vehicle and steers the vehicle toward the road.

* * * * *